United States Patent [19]

Romagnoli

[11] Patent Number: 4,890,440

[45] Date of Patent: Jan. 2, 1990

[54] METHOD OF PRODUCING PACKAGING BOXES AND PACKAGING BOXES OBTAINED WITH THIS METHOD

[75] Inventor: Andrea Romagnoli, San Lazzaro Di Savena, Italy

[73] Assignee: Cestind - Centro Studi Industriali - S.R.L., San Pietro Terme, Italy

[21] Appl. No.: 210,716

[22] Filed: Jun. 23, 1988

[30] Foreign Application Priority Data

Jul. 29, 1987 [IT] Italy ..... 3577 A/87

[51] Int. Cl.[4] ..... B65B 43/10; B65B 19/20

[52] U.S. Cl. ..... 53/456; 493/362

[58] Field of Search ..... 229/160.1; 493/81, 79, 493/68, 67, 71, 74, 62, 56, 116, 102, 84, 362, 363; 53/456, 452, 558

[56] References Cited

U.S. PATENT DOCUMENTS 2,911,888 11/1959 Biel et al. ..... 493/362 X 3,956,865 5/1976 Schmermund ..... 53/456

4,785,696 11/1988 Martiny ..... 493/362

*Primary Examiner*—James F. Coan

*Attorney, Agent, or Firm*—Herbert Dubno

[57] ABSTRACT

A method of producing packaging boxes starting from pallets of sheets of board each having stamped therein a plurality of plane blanks joined in adjacent transverse and longitudinal strips by connections which can be broken and are provided with notches, fold lines and break lines defining the members for producing and closing the boxes. The method involves a sequence of steps consisting in the sequential take-up of the sheets from the pallet and the sequential separation of these sheets into strips and the separation of the strips into individual plane blanks which are supplied in individual succession to a box production line along which a respective portion defined by one of the break lines is separated and reapplied in order to obtain boxes of the flanged type after they have been folded internally around the fold lines and the production and closure members have been glued.

3 Claims, 4 Drawing Sheets

Fig. 1
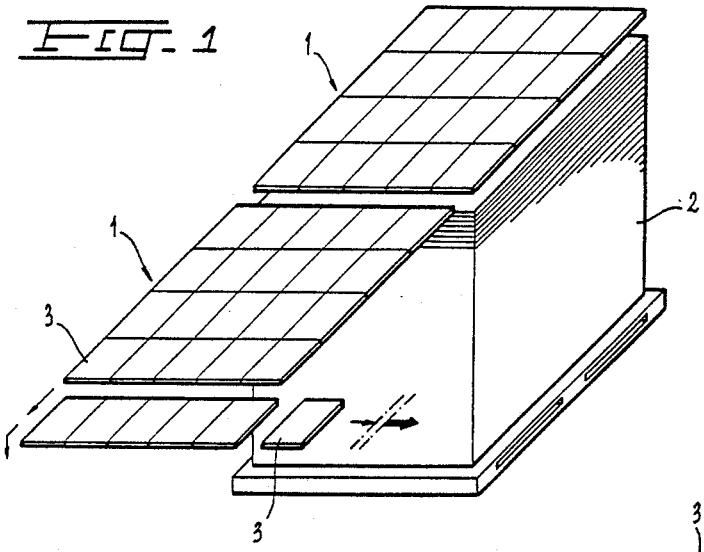
Fig. 3
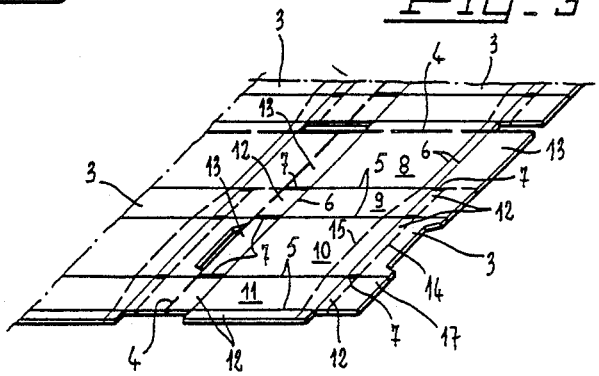
Fig. 4
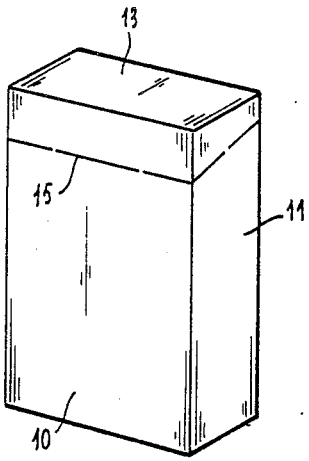
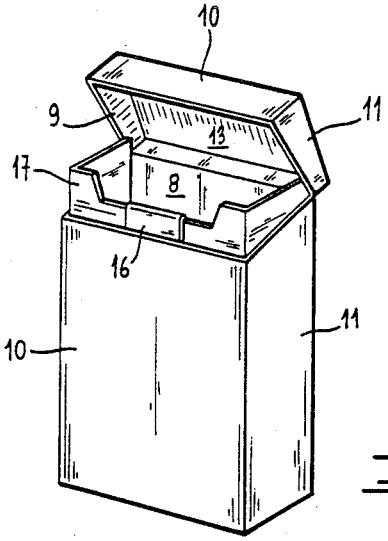
Fig. 5

FIG. 1A
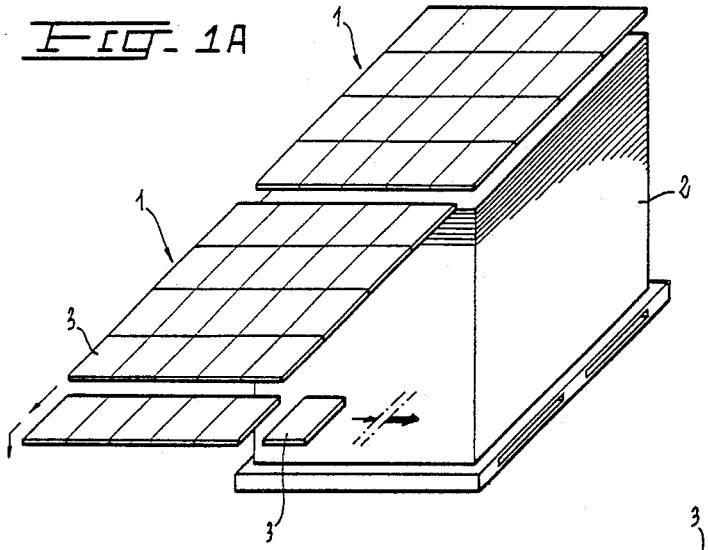
FIG. 3A
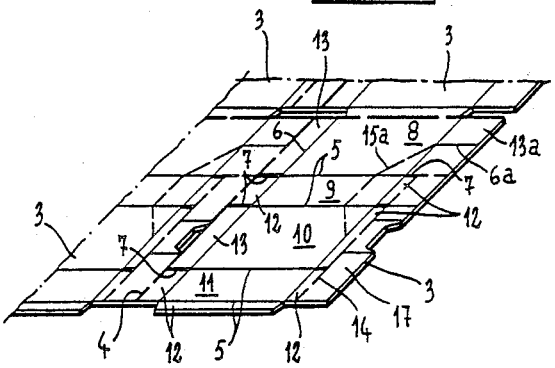
FIG. 4A
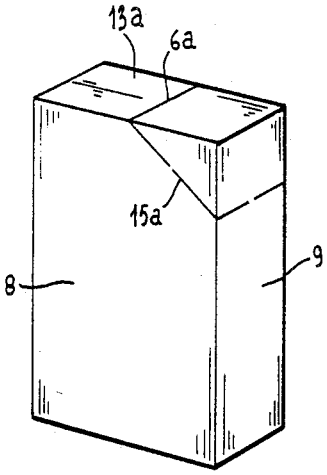
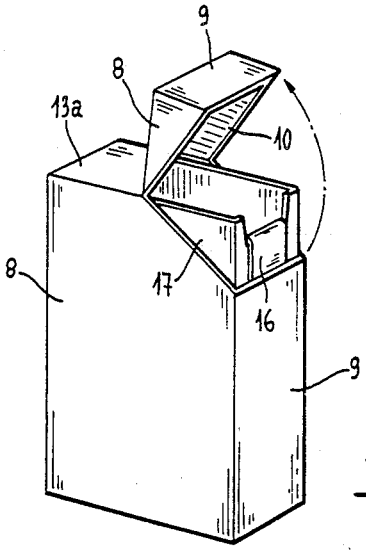
FIG. 5A

METHOD OF PRODUCING PACKAGING BOXES AND PACKAGING BOXES OBTAINED WITH THIS METHOD

FIELD OF THE INVENTION

The present invention relates to a method for the production of packaging boxes and to the packaging boxes obtained with this method.

BACKGROUND OF THE INVENTION

In the field of the packaging or wrapping of foodstuffs, household products such as detergent powders, pharmaceuticals and the like it is known to use prefabricated cases or boxes in a flat folded tubular shape which are supplied to the packaging machines for these products by taking them up in individual sequence from a store, usually of the hopper type, in which they are stacked. During the stage in which they are individually supplied, they are converted or erected into their tubular shape so that the product to be packaged can be supplied thereto and thereafter their opposite ends or heads are closed.

At present the process for obtaining these prefabricated boxes in this flat folded tubular shape substantially comprises a first stage for the preparation of sheets of board each comprising stamped therein in transverse and longitudinal rows or strips, a plurality of plane blanks joined together by connections which can be broken with notches defining the members for producing and closing the boxes and the separation of these sheets into individual plane blanks at the locations of these breakable connections for their palletization in superimposed layers with interposed plane support elements in transversally and longitudinally adjacent multiple stacks, and a second stage for the manual supply of these individual stacks of successive layers to a supply hopper from which these blanks are taken up and supplied in individual sequence for the operations for folding and glueing in the flat folded tubular shape and are usually packaged in this shape in boxed stacks or packs so that they can be supplied to consumers for the packaging therein of foodstuffs, household products such as detergent powders, pharmaceuticals and the like.

The machines for carrying out the above process to obtain these prefabricated boxes in their flat folded tubular shape are relatively complex and extremely costly with the result that advances in technology in the specific sector of packaging have led to testing of other methods to solve the problem of supplying these plane stamped members or blanks and their production as packaging boxes.

OBJECTS OF THE INVENTION

The main object of the present invention is thus to provide a method for the production of packaging boxes by supplying plane stamped members or blanks in individual sequence starting from pallets of sheets with a plurality of stamped elements.

A further object of the present invention, in accordance with the preceding object, is to produce, using this method, the individual plane stamped members or blanks supplied in individual sequence in their tubular shape for containing the products to be packaged as they are fed along a production line.

A further object of the present invention, in accordance with the preceding objects, is to obtain a packaging box with a sealed closure guaranteeing the products contained therein.

A further object of the present invention, in accordance with the preceding objects, is to provide a packaging box of the so-called flanged type without having to make use of an auxiliary supply of the material needed for the formation of this flange.

A further object of the present invention is to allow the implementation of the method in accordance with the preceding objects in an automatic manner by means of a particularly simple discontinuously or even continuously operating machine with high productivity per unit of time and a relatively low cost in relation to the results which can be achieved therewith.

SUMMARY OF THE INVENTION

These and other objects to be described in detail below are all achieved with the method of the invention designed to produce boxes for the packaging of foodstuffs, household products such as detergent powders, pharmaceuticals and like, starting from pallets of sheets of board each comprising stamped therein a plurality of plane blanks joined together in adjacent transverse and longitudinal strips by connections which can be broken and are provided with notches, fold lines and break lines defining the members for producing and closing these boxes. The method comprises a sequence of steps including the sequential take up from the pallet of these sheets with multiple adjacent strips of plane stamped elements or blanks, the sequential separation at the location of the respective break members of these strips of multiple plane stamped members or blanks from the sheet of multiple strips taken from the pallet, the sequential separation, also at the location of the respective break members, of these plane stamped members or blanks from these strips of multiple stamped members or blanks, the supply in individual sequence of these plane stamped members or blanks separated from the strips with multiple blanks, the detachment of a portion from these individual plane stamped members or blanks supplied in sequence at the respective break line and the application of this portion to the respective individual plane stamped members design to form the relative flange of the corresponding box, the folding about the respective fold lines of these plane stamped members and the associated glueing of the respective member for the production of the latter in their tubular shape to contain the products to be packaged and the folding of the members for producing and closing the opposite ends or heads by glueing providing boxes of the flanged type with a sealed closure guaranteeing the products contained therein along the relative break line.

A particular feature offered by the method of the invention is that of being able to package the products during the production of these boxes by folding the relative blanks around the corresponding products to be packaged, or by inserting these products through one end after the blanks have been produced in their tubular shape, even after the closure of one of these ends, or at any time after production is complete through one end which is obviously kept open.

BRIEF DESCRIPTION OF THE DRAWING

Further characteristic features and advantages of the method of the invention will be illustrated in detail in the following description of two preferred embodiments with reference to the accompanying drawing, in which:

FIG. 1 is a perspective view of the pallet of sheets of plane stamped members or blanks from which these sheets are progressively taken up in individual sequence for the individual supply of these plane stamped members or blanks in accordance with the method of the present invention;

FIG. 3 is a further perspective view showing in diagrammatic form and on an enlarged scale a detail of the structure connecting the stamped members or blanks in the sheets of multiple stamped members or blanks;

FIGS. 4; and 5 are perspective views of closed and open boxes obtained with the above method and FIGS. 1A to 5A are views similar to FIGS. 1 to 5 for the fabrication of a box in accordance with a second embodiment of the present invention.

SPECIFIC DESCRIPTION

Figure 2:
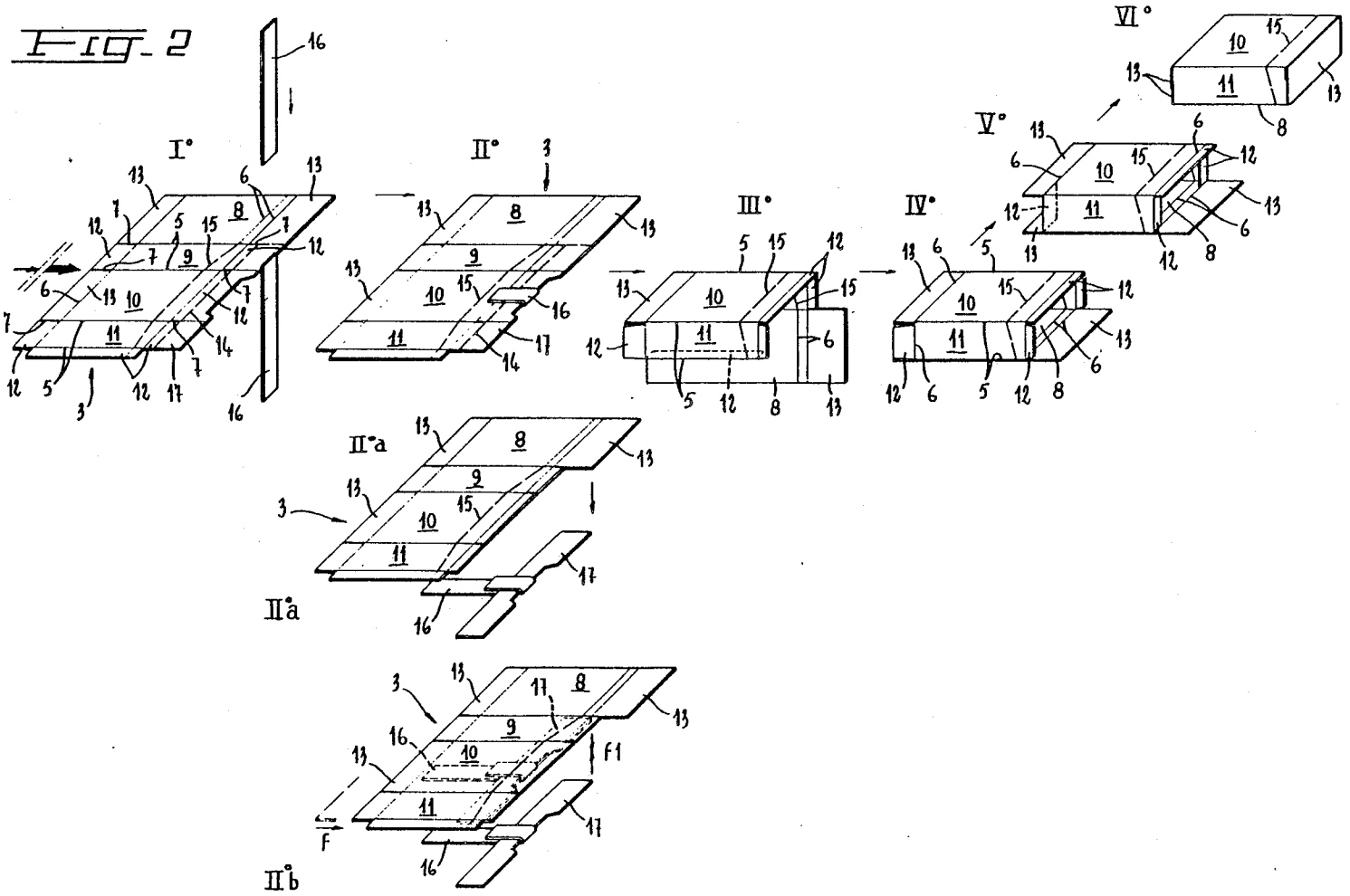
FIG. 2 is a further perspective view on an enlarged scale of the sequence of stages for the production of the individual plane stamped members or blanks as packaging boxes in accordance with a preferred embodiment of the present invention.
Figure 2A:
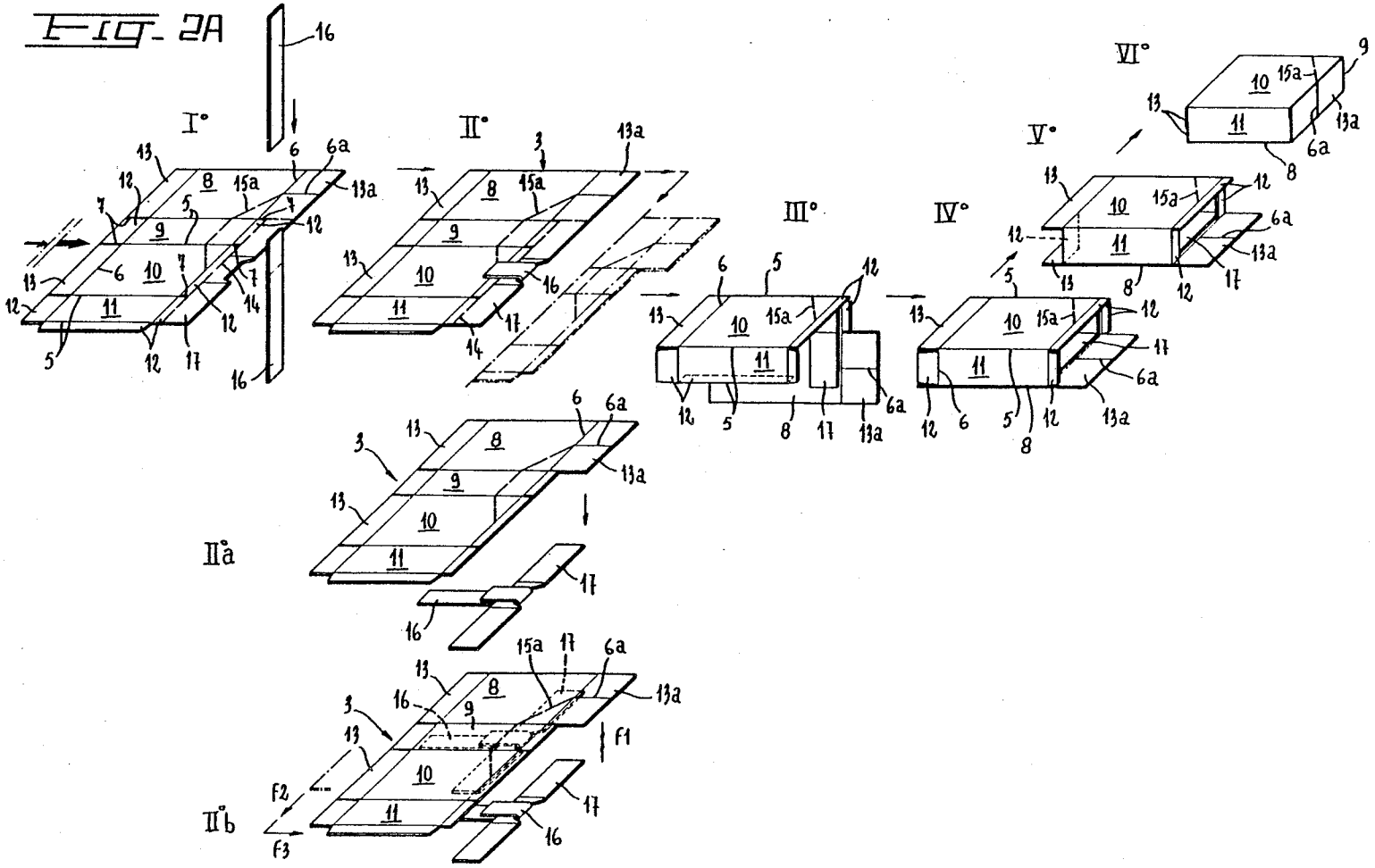

As mentioned above, the ultimate aim of the present invention is to be able to provide packaging boxes starting directly from the pallet of sheets with multiple plane stamped members or blanks without having to pass, as is currently the case with the prior art in the specific sector of packaging, through the extremely costly stage for the production of these plane stamped members or blanks in the flat folded tubular shape prior to their use for packaging purposes.

These palletized sheets 1 of board shown in FIG. 1 by 2 each comprise stamped therein along break lines 4 a plurality of plane blanks 3 connected together in adjacent transverse or longitudinal strips by breakable connection members which can be seen in FIG. 3 along the break lines 4. The lateral walls 8, 9, 10, 11 and the production members (joining tabs) of 12 and closure members 13 for the boxes are defined in these plane blanks 3 by longitudinal fold lines 5, transverse fold lines 6 and notches 7 (see in particular FIG. 3 and FIG. 2, position I). In accordance with the present invention, break lines 14 and 15 are also provided in these plane blanks 3 for the reasons which will be explained in detail in the following description.

The sheets 1 formed in this way with a plurality of transversally and longitudinally adjacent plane stamped members or blanks 3, palletized as shown in FIG. 1 by 2 are, in accordance with the inventive concept of the invention, taken up sequentially from the pallet 2 (see FIG. 1), divided sequentially into transverse or longitudinal strips with a plurality of blanks along the respective break lines 4 and the strips are divided, still sequentially, at the connection members of the corresponding break lines 4 into individual blanks 3 (see FIG. 1 in particular) so as to be supplied in individual sequence along a production line for the packaging therein of the products to be packaged in the manner described below with reference to FIG. 2 which shows by way of example and on an enlarged scale with respect to FIG. 1 one of the preferred ways of embodying the method of the invention.

The individual plane stamped members or blanks 3 are supplied along this production line as shown in FIG. 2 and are subjected to a sequence of steps which have been shown as positions I, II, IIa, IIb, III, IV, V and VI for the implementation of these steps. In position I, while the plane stamped member or blank 3 is being supplied it intercepts an element 16 containing information on the product contained in the box which is packaged therewith and conventionally provided with these boxes in the packaging sector and is disposed astride a leading edge as shown in position II. In a stage subsequent to that shown in position II, a portion 17 is detached from the plane blank 3 along the break line 14 which defines it (position IIa) and designed to form, when the box is packaged in the manner to be described below, the flange of the corresponding packaging box for this type of box with a flange closure described by way of example. In position IIb the plane blank 3 is supplied in the direction of the arrow f above the flange portion 17 and information element 16 assembly or alternatively the assembly 17-16 is moved rearwards below the plane blank 3 so that they can be applied together via a movement in the respective directions of the arrow f1 in the way shown in dashed lines in position IIb, i.e. to overlap with a portion of the panel having the breakline at which the flange portion 17 was separated.

In positions II and IV the plane blank 3 prepared in this way with the assembly of the flange portion 17 and the information element 16 detachable therefrom is folded over the respective fold lines 5 and the wall 8 is glued to the corresponding member 12 for its production in the tubular shape to contain or receive the products to be packaged. In positions V and VI the production members 12 and closure members or heads 13 are folded over the respective fold lines 6 and glued to one another providing boxes of the type with a flange and a sealed closure guaranteeing the products contained therein along the break line 15 (see FIGS. 4 and 5).

With a method of this type for the production of packaging boxes it is thus obvious that the possibility of carrying it out automatically has been attempted using a discontinuously or even continuously operating machine, packaging the products in the latter case during the box production stages by folding the relative blanks around the corresponding products to be packaged, or, in the former case, by inserting these products through one end which could take place in stage IV or V or at any other time when production is complete through the end opposite that with the guarantee seal at 15 which is kept open and then subsequently sealed.

The embodiment of the box of the present invention shown in FIGS. 1A to 5A differs from that described above with reference to FIGS. 1 to 5 which has a flange closure and a conventional lid hinged about the fold line 6 opposite, when the box is packaged, the break line 15 of the guarantee seal for the product contained therein, since in this case the flange closure is provided at one corner of the box with the relative lid hinged about a fold line transverse to the head of this lid. The member, the transverse fold line forming the hinge and the break line which defines a lid of this type in the corresponding plane stamped member or blank 3 are indicated by the same reference numerals as in the previous embodiment described with reference ot FIGS. 1 to 5 with the addition of a lower case a, i.e. by 13*a*, 6*a* and 15*a* respectively. In addition, in the stage corresponding to position IIb, the difference lies in the fact that in addition to the feed movement for the plane blank 3 provided in the previous embodiment it is also moved in the same plane in the longitudinal direction, i.e. in the case shown, towards anyone looking at the drawing (see arrows f2 and f3 in position IIb in this Figure).

The description of the method in question made with reference to the attached drawings is obviously given solely by way of example and it is therefore evident that any modifications and variants suggested by practice and by its application and use can be made thereto without departing from the scope of the following claims.

I claim:

1. A method of fabricating boxes, comprising the steps of:

(a) forming a stack of sheets of individual planar container blanks joining one another by break lines between strips of said blanks and between blanks of said strips whereby said break lines extend generally longitudinally and transversely of each sheet, each of said blanks being further formed with score lines between side panels, a cover panel, a bottom panel, a front panel, a rear panel, and gluing tabs enabling said panels to be glued upon erection into a box shape, each of said blanks being additionally formed with a separation line between a respective flange strip and a remaining portion of the respective blank;

(b) individually removing said sheets from said stack;

(c) separating a strip from a sheet removed from said stack along a respective one of said break lines extending in a direction transverse to said one of said break lines;

(d) displacing said strip separated in step (b) in a direction parallel to said one of said break lines and successively separating individual ones of said blanks from the displaced strip along respective break lines transverse to said one of said break lines;

(e) repeating steps (b) through (d) for all of the sheets of said stack;

(f) for each blank individually separated in step (d), separating the respective flange therefrom by relatively displacing the respective flange and the respective remaining portion in a direction perpendicular to a plane of the respective blank and thereafter reapplying said flange to the respective remaining portion by a relative movement of said flange and said remaining portion so that said flange projects beyond an edge of said remaining portion and overlaps said remaining portion along a side thereof adapted to form an interior of the respective box; and (g) for each blank provided with an overlapping flange in step (f), thereafter folding said panels and said tabs and folding same into said box shape with said flange being located so as to be exposed upon opening of a cover of the box.

2. The method defined in claim 1 wherein each of said blanks is moved, prior to separation of the respective flange, past a respective information strip to fold the respective information strip around said flange prior to the separation thereof from said blank.

3. The method defined in claim 2 wherein each of said blanks is formed with a further break line separating upon opening of said cover to reveal the respective edge and information strip.

* * * * *